United States Patent [19]

Rogers

[11] Patent Number: 4,624,116

[45] Date of Patent: Nov. 25, 1986

[54] LOOP PILE WARP KNIT, WEFT INSERTED FABRIC

[75] Inventor: Jack S. Rogers, Spartanburg, S.C.

[73] Assignee: Milliken Research Corporation, Spartanburg, S.C.

[21] Appl. No.: 720,953

[22] Filed: Apr. 8, 1985

Related U.S. Application Data

[63] Continuation of Ser. No. 559,939, Dec. 9, 1983, abandoned, which is a continuation-in-part of Ser. No. 365,535, Apr. 5, 1982, abandoned.

[51] Int. Cl.[4] ..... D04B 23/08; D04B 23/12; A44B 18/00

[52] U.S. Cl. ..... 66/193; 24/445; 24/450

[58] Field of Search ..... 24/445, 450; 66/193

[56] References Cited

U.S. PATENT DOCUMENTS

| | | | |
|---|---|---|---|
| 2,899,813 | 8/1959 | Herrnstadt | 66/193 X |
| 2,968,085 | 1/1961 | Matthews | 66/193 X |
| 3,109,302 | 11/1963 | Vitek | 66/193 |
| 3,568,474 | 3/1971 | Berthold | 66/193 |
| 3,577,607 | 5/1971 | Ikoma et al. | 24/450 X |
| 3,708,833 | 1/1973 | Ribich et al. | 24/450 |
| 3,808,648 | 5/1974 | Billarant et al. | 24/450 |

FOREIGN PATENT DOCUMENTS

| | | | |
|---|---|---|---|
| 58087 | 8/1982 | European Pat. Off. | 66/193 |
| 47-9867 | 3/1972 | Japan | 66/193 |
| 51-102176 | 9/1976 | Japan | 66/193 |
| 1162985 | 9/1969 | United Kingdom | 66/193 |
| 665037 | 5/1979 | U.S.S.R. | 66/193 |
| 711201 | 1/1980 | U.S.S.R. | 66/193 |

OTHER PUBLICATIONS

Reisfeld, Warp Knit Engineering, 1966, National Knitted Outerwear Association, pp. 407, 408 and 409.

*Primary Examiner*—Wm. Carter Reynolds
*Attorney, Agent, or Firm*—Earle R. Marden; H. William Petry

[57] ABSTRACT

A warp knit, weft inserted lap side loop pile fabric for use as the loop, fabric for an article of manufacture which has hooks thereon to engage the loops to hold the article of manufacture in a pre-selected position. In one form of the invention the lap side loop pile fabric is coated with an acrylic latex to provide strength and rigidity.

1 Claim, 5 Drawing Figures

LOOP PILE WARP KNIT, WEFT INSERTED FABRIC

This is a continuation of application Ser. No. 559,939, filed Dec. 9, 1983, now abandoned, which in turn is a continuation-in-part of application Ser. No. 365,535, filed on Apr. 5, 1982, now abandoned.

This invention relates generally to a warp knit, weft inserted fabric which can be employed as the female fabric for securing an article of manufacture in a preselected position which may or may not have a coated backing for strength and rigidity.

Therefore, it is an object of the invention to provide a warp knit, weft inserted lap side loop pile fabric which can be employed as the female member of a securing means.

Other objects and advantages of the invention will become readily apparent as the specification proceeds to describe the invention with reference to the accompanying drawings, in which.

Figure 1:
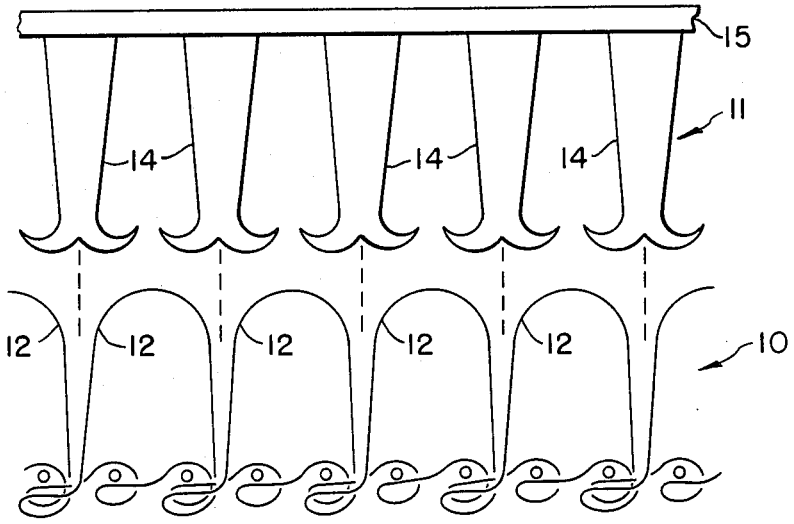
FIG. 1 is a schematic representation of the hook fasteners in relation to the novel loop pile fabric.

Looking now to FIG. 1, the new and improved fabric 10 will upstanding loops 12 are shown in position where they can be engaged by the hook member 11 which consists of the hooks 14 connected to a support member 15. In practice, the fabric 10 would be connected to a supporting structure (not shown) so that when the article to be secured in a fixed position, to which the hook member 11 is attached, as projected towards the loops 12, the hooks 14 will engage same and be secured therein. The hook member 11 is not, per se, a part of the invention and can be any suitable type, such as that formed by the molding or casting of nylon to form the desired configuration shown in FIG. 1.

Figure 2:
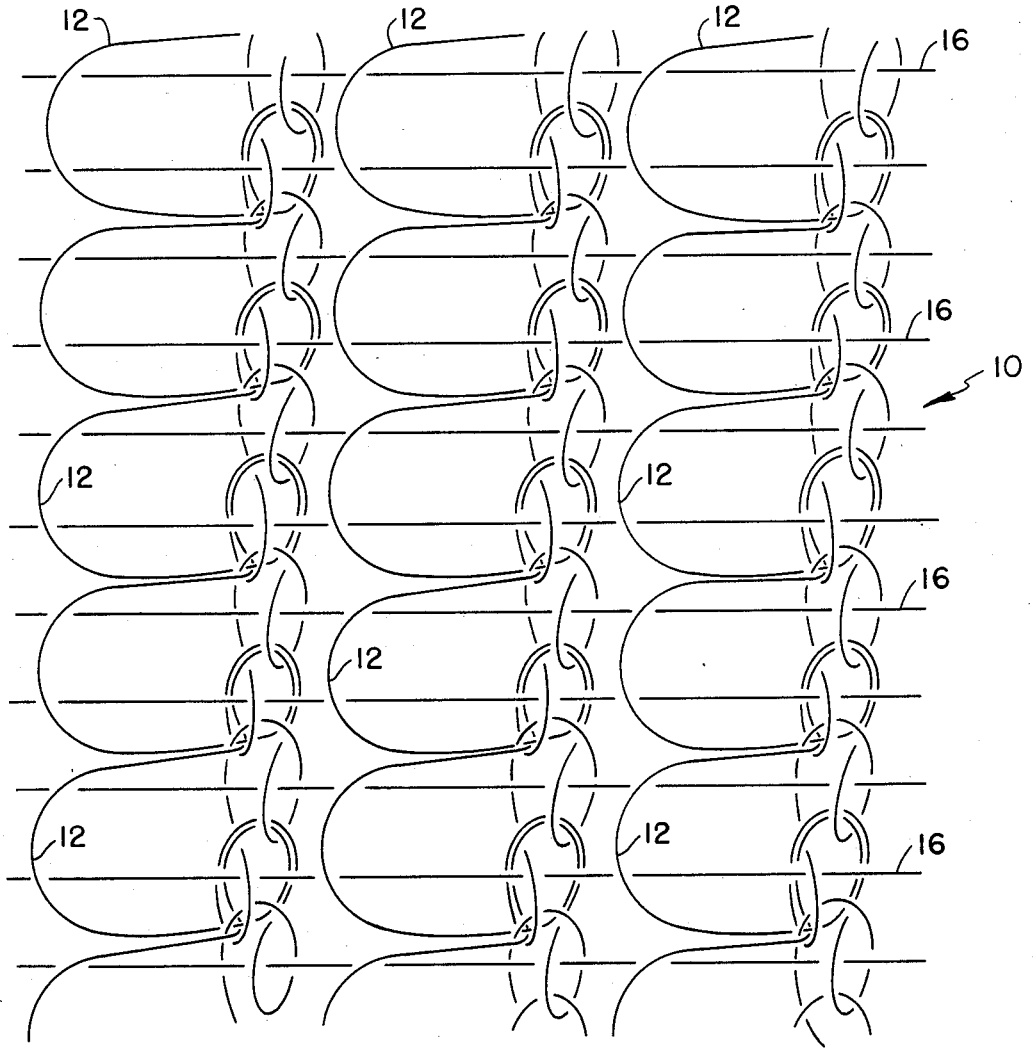
FIG. 2 is the top view of the lap (technical back) side of the novel warp knit fabric.

The substrate fabric 10, as represented in FIGS. 1–5, is a warp knit, weft inserted fabric knit on a two-bar, weft insertion warp knitting machine. As indicated in FIGS. 1 and 2, the loops 12 are lap loops formed by the front bar of the knitting machine while each of the weft inserted yarn 16 are held therein substantially parallel to one another by and between the chain stitch wales 18 formed by the back bar. The fabric 10 thereby presents a surface of loops 12 which can be readily manufactured on a warp knitting machine and at the same time provides added strength due to the insertion of the weft yarn 16. The loops 12, as shown in FIG. 1, are free loops in the sense that they are open and project freely upward and are connected only at the base to their respective wale.

Figure 3:
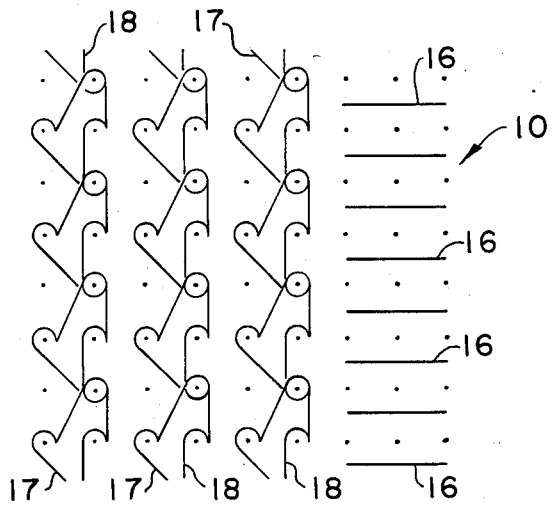
FIG. 3 is a point diagram of the action of the guide bars of the knitting machine.

FIGS. 1–3 show one form of the novel fabric constructed with the pattern wheel for the front bar 70 denier polyester yarn set to knit a 1–0, 2–1 tricot stitch 17 and the pattern wheel for the back bar 150 denier polyester yarn set to knit a 0–1, 1–0 chain stitch. The weft inserted filling yarn 16 is a 150 denier polyester yarn. This form of the fabric provides a lap side loop the height of which is slightly less than the spacing between adjacent wales of the chain stitch yarn 18.

Figure 4:
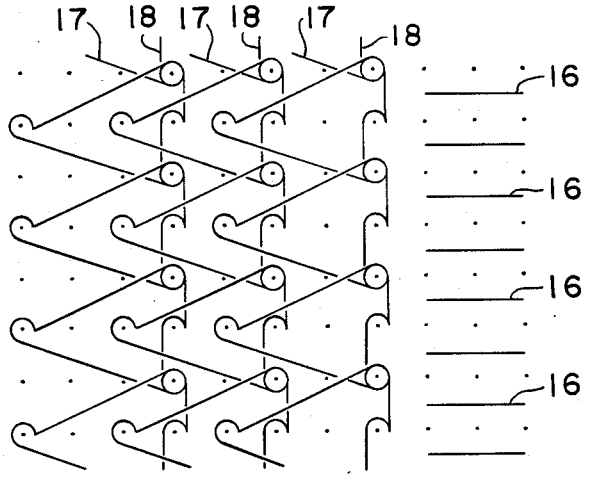
FIG. 4 is a point diagram of the guide bars of the knitting machine to produce a modification of FIGS. 1–3.

If it is desired to provide a fabric with a longer lap side loop, the construction shown in FIG. 4 can be employed with the pattern wheel for the front bar set to knit a 1–0, 4–3 tricot stitch and the pattern wheel for the back bar set to knit a 0–1, 1–0 chain stitch. In the form of the invention the lap loop 12 for engagement by the hooks 14 will have a potential height greater than the distance between adjacent wales in the fabric.

Figure 5:
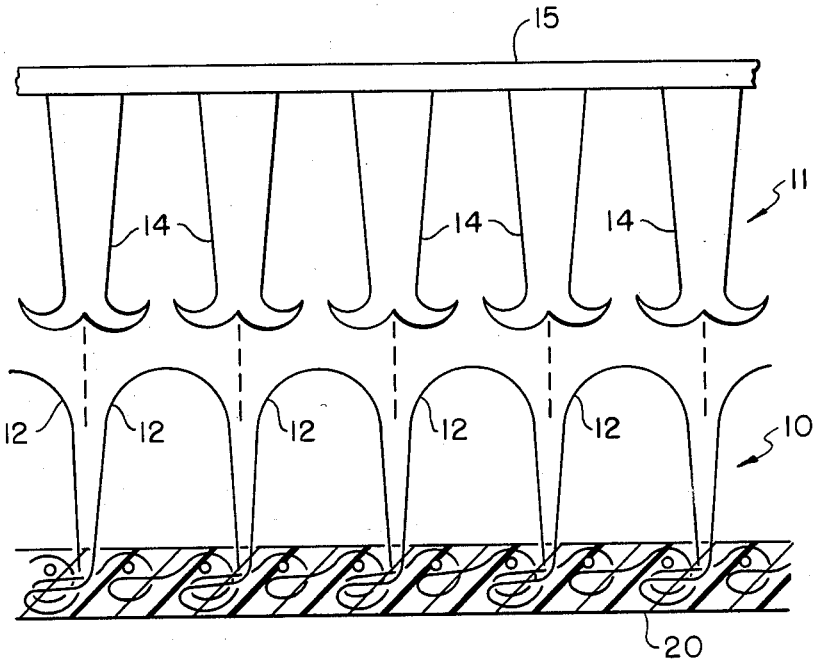
FIG. 5 is a view similar to FIG. 1 showing the female fabric member coated with a strengthening material.

FIG. 5 shows the basic substrate fabric 10 coated with an acrylic latex foam with the bubbles broken after coating. The acrylic latex is placed on the fabric in a foam condition and the bubbles are then broken with a knife. After the bubbles are broken, the acrylic latex is set by the application of heat. This provides strength and rigidity to the substrate so that it can readily be handled and has a longer service life.

It can readily be seen that a knit fabric has been disclosed which can readily function as the female member of a hook and loop connection and which does not readily tear due to the weft inserted yarn that provides stability in the weft direction of the fabric.

Although I have described in detail the specific embodiments of the invention, it is contemplated that changes may be made without departing from the scope or spirit of the invention and I desire to be limited only by the claims.

I claim:

1. An interlocking, readily separable closure member comprising: a male member having a plurality of hooks on one side thereof and a female member having a plurality of loops upstanding therefrom engaged by said hooks, said female member having a two-bar warp knit fabric having a face side and a back side, said face side of said fabric having a plurality of spaced wales of chain stitches, said back side of said fabric having a plurality of spaced wales of tricot stitches with a lap portion of each of said tricot stitches projecting outwardly therefrom to form a free loop connected only at its base to its respective wale, and a weft yarn inserted into each course of said fabric between the face and back side of said fabric and extending across the full width of said fabric in the weft direction and held substantially parallel to one another by said chain stitches, the faceside of said warp knit fabric being coated with an acrylic latex.

* * * * *